US007370587B2

(12) United States Patent
Janson et al.

(10) Patent No.: US 7,370,587 B2
(45) Date of Patent: May 13, 2008

(54) MODULAR WHEEL ASSEMBLY FOR A CARRIAGE IN A MOBILE STORAGE SYSTEM

(75) Inventors: Steven L. Janson, Deerfield, WI (US); Brian R. Nemec, Delavan, WI (US); Steven S. Dingle, McFarland, WI (US)

(73) Assignee: Spacesaver Corporation, Fort Atkinson, WI (US)

( * ) Notice: Subject to any disclaimer, the term of this patent is extended or adjusted under 35 U.S.C. 154(b) by 0 days.

(21) Appl. No.: 11/011,997

(22) Filed: Dec. 14, 2004

(65) Prior Publication Data

US 2006/0124025 A1 Jun. 15, 2006

(51) Int. Cl.
*E01B 25/22* (2006.01)

(52) U.S. Cl. ..... 104/106

(58) Field of Classification Search ..... 105/76, 105/422; 104/106, 107; 245/39, 40, 42, 245/43; 301/111.01
See application file for complete search history.

(56) References Cited

U.S. PATENT DOCUMENTS

| | | | |
|---|---|---|---|
| 3,575,479 | A | 4/1971 | Kombuchen |
| 4,417,524 | A | 11/1983 | Quinn et al. |
| 4,421,365 | A | 12/1983 | Taniwaki |
| 4,771,901 | A | 9/1988 | Griswold et al. |
| 4,802,622 | A | 2/1989 | Homan |
| 4,944,231 | A | 7/1990 | Leist |
| 4,984,737 | A | 1/1991 | Muth et al. |
| 5,007,351 | A | 4/1991 | Muth |
| 5,024,164 | A | 6/1991 | Leist |
| 5,148,754 | A | 9/1992 | Lahti et al. |
| 5,435,639 | A | 7/1995 | Smits et al. |
| 5,683,155 | A | 11/1997 | Sarno |
| 6,112,917 | A | 9/2000 | Baker et al. |
| 6,161,485 | A | 12/2000 | Muth |
| 6,371,031 | B1 | 4/2002 | Muth |
| 6,416,143 | B1 | 7/2002 | Janson |
| 6,644,213 | B2 | 11/2003 | Muth |
| 6,669,314 | B1 | 12/2003 | Nemec et al. |
| 2004/0104647 | A1 | 6/2004 | Nemec et al. |

FOREIGN PATENT DOCUMENTS

| | | |
|---|---|---|
| EP | 1391167 | 4/2004 |
| JP | 11292215 | 10/1999 |

*Primary Examiner*—S. Joseph Morano
*Assistant Examiner*—Robert J. McCarry, Jr.
(74) *Attorney, Agent, or Firm*—Boyle Fredrickson, S.C.

(57) ABSTRACT

A carriage of a mobile storage system is adapted to support at least one storage unit for movement on a rail. The carriage generally includes a wheel mount structure, and a wheel mounting subassembly that includes a shaft having opposing ends, a wheel mounted to the shaft, and a first and a second mounting members that rotatably support the shaft. The wheel is located between the first and second mounting members such that the ends of the shaft extend outwardly from the first and second mounting members. The carriage further includes a cooperating mounting arrangement configured to non-rotatably mount the first and second mounting members to the wheel mount structure. The wheel extends downward from the wheel mount structure to engage the rail, and the ends of the shaft extend outward to engage a drive shaft that imparts rotation to the shaft and wheel so as to move the carriage on the rail.

22 Claims, 4 Drawing Sheets

MODULAR WHEEL ASSEMBLY FOR A CARRIAGE IN A MOBILE STORAGE SYSTEM

BACKGROUND AND SUMMARY OF THE INVENTION

This invention relates to a mobile storage system for movably mounting storage units such as shelves or file cabinets, and more particularly to a wheel mounting arrangement for the carriage of such a mobile storage system.

High density mobile storage systems are commonly used when it is desired to increase the storage capacity in a given area greater that which is attainable using fixed shelving. A typical mobile storage system employs a series of mobile platforms or carriages to which storage units such as shelves or file cabinets are mounted, and which are movably supported on a series of parallel rails. The carriages extend across the rails, and a number of storage units are mounted to and movable with each carriage. By allowing the storage units to move, the aisle space normally required between storage units for access to the storage units may be eliminated for all but one pair of storage units. This single aisle space may be shared among pairs of storage units by movement of the storage units along the rails. The carriages are typically movable on the rails in response to operation of any satisfactory type of drive system associated with the carriages, for selectively creating an aisle between adjacent storage units so as to provide access to items stored in or on the storage units.

Certain known mobile storage systems employ a formed steel carriage that includes a series of wheel assemblies for moving the carriage along the rails. Each wheel assembly generally includes a wheel mounted to a shaft, and associated wheel bearings that are assembled to the formed sheet metal components of the carriage. A number of steps are involved in mounting each wheel assembly to the carriage, including securing the bearing assemblies to the carriage, positioning the wheel between the bearing assemblies, inserting the shaft through the bearings and the wheel, etc. In addition, in existing systems of this type, the load from the wheel is transferred to the carriage through the bearing and its bolted connection to the carriage. This construction applies significant loads to the bearings and the bolted connections, which can lead to excessive stress and premature failure of the bearings, carriage wheel assemblies, and/or the bearing connections under severe loads.

The present invention addresses these problems by providing a modular wheel assembly that can reduce the labor needed in assembly, as well as improve the carriage life and load carrying ability of the carriage. The modular wheel assembly of the present invention is configured to provide drop-in assembly to the carriage, which reduces the labor involved in initial assembly and also enables quick and easy replacement in the field. The modular wheel assembly is also configured to transfer the wheel load to the top of the carriage member in a manner that extends the operating life of the wheels and the carriage.

In accordance with the present invention, a carriage for a mobile storage system is adapted for placement over a rail, and is configured to support at least one storage unit for movement on the rail. The carriage generally includes a drive arrangement, a wheel mount structure, a shaft defining a pair of ends, a wheel mounted to the shaft, and first and second mounting members to which the shaft is rotatably mounted. The wheel is located between the first and second mounting members such that each end of the shaft extends outwardly from one of the first and second mounting members. The carriage further includes a cooperating mounting arrangement associated with the wheel mount structure and the first and second mounting members for non-rotatably mounting the first and second mounting members to the wheel mount structure. The cooperating mounting arrangement is configured such that the wheel extends downwardly from the wheel mount structure for engagement with the rail and the ends of the shaft extend outwardly from the wheel mount structure. One of the ends of the shaft engages the drive arrangement in a manner such that the drive arrangement imparts rotation to the shaft and to the wheel to move the carriage on the rail.

In one embodiment of the carriage, the wheel mount structure includes a structural member of the carriage having a first sidewall spaced from a second sidewall. The cooperating mounting arrangement generally includes an opening in each of the sidewalls and an engagement section associated with each of the first and second mounting members. Each engagement section is configured to be received within the opening in one of the first and second sidewalls of the structural member. Each of the first and second mounting members is secured to one of the first and second sidewalls of the structural member via one or more fasteners. Each of the first and second mounting members is adapted to be positioned within the space between the sidewalls of the structural member. The engagement section of each of the first and second mounting members extends outwardly into the opening of the first and second sidewalls. The structural member of the carriage further includes an upper wall that extends between and interconnects the spaced apart sidewalls. Each of the first and second mounting members includes an upper edge that engages an inner surface defined by the upper wall of the structural member. The fastener is located between the upper edge and the engagement section of each of the first and second mounting members. Each of the first and second structural member sidewalls defines a lower edge, and the opening in each of the first and second sidewalls extends upwardly from the lower edge. The engagement section of each of the first and second mounting members includes a rim that surrounds an opening through which the shaft extends. The rim and the opening in each of the first and second mounting members has a matching configuration that enables the rim to be received within the opening in the first and second sidewalls of the structural member. The shaft, the wheel, and the pair of mounting members generally comprise a wheel subassembly that is secured as a unit to the wheel mount structure. In one embodiment, the mounting members are in the form of bearing housings, each of which includes a bearing through which the shaft extends.

The invention also provides a method of mounting a wheel to a carriage of a mobile storage system. The carriage is configured to support one or more storage units for movement on a rail. The method includes the acts of providing a wheel mount structure with a first sidewall spaced apart from a second sidewall; forming an opening in each of the first and second spaced apart sidewalls of the wheel mount structure; providing a wheel assembly including a shaft, a wheel mounted to the shaft, and a first and a second mounting member to which the shaft is rotatably mounted, such that the wheel is located between the first and second mounting members; engaging each of the first and second mounting members within the opening in one of the first and second spaced apart sidewalls of the wheel mount structure; and securing each of the first and second mounting members to one of the first and second spaced apart sidewalls of the wheel mount structure.

The invention also provides a mobile storage system in which one or more storage units are carried by a carriage adapted to be movably supported on one or more rails. The carriage generally includes a wheel mount structure configured for placement over one of the rails. The mobile storage system includes a wheel subassembly for mounting a wheel to the wheel mount structure. The wheel subassembly includes a first and a second mounting member and a shaft that is rotatably supported by the first and second mounting members. The wheel is non-rotatably secured to the shaft between the first and second mounting members, and is positioned to engage one of the rails. The wheel mount structure and the first and second mounting members include a cooperating engagement structure for non-rotatably engaging the pair of first and second mounting members with the wheel mount structure.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figures 1, 2, 3, 4:
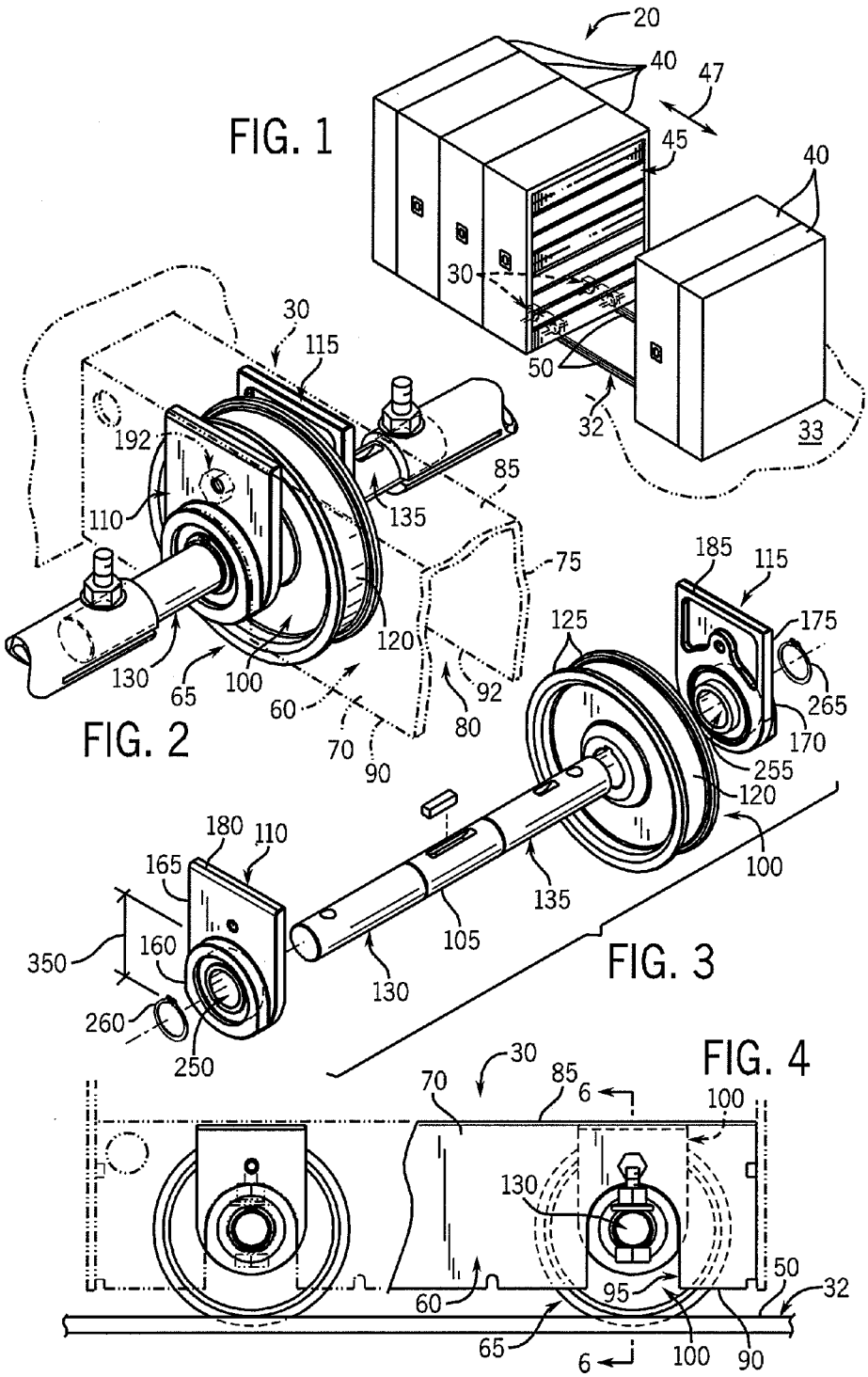
FIG. 1 is an isometric view of a mobile storage system including a series of storage units movable on a series of rails, with each storage unit being mounted to a carriage incorporating one or more modular wheel assemblies in accordance with the invention.
FIG. 2 is an enlarged isometric view showing a modular wheel assembly of the present invention, which is incorporated into the mobile storage system of FIG. 1.
FIG. 3 is an exploded isometric view of the modular wheel assembly shown in FIG. 2.
FIG. 4 is a side elevation view of a carriage forming a part of the mobile storage system of FIG. 1, and to which wheels are mounted using the modular wheel assembly as shown in FIGS. 2 and 3.

FIG. 1 illustrates a mobile storage system 20 constructed in accordance with the present invention. Mobile storage system 20 generally includes one or more carriages 30 supported on a rail system 32 that rests on a floor 33 or other supporting surface. Each carriage 30 is adapted to support one or more storage units 40. The storage units 40 are of conventional construction and generally include spaced apart sidewalls, a top wall, a bottom wall and a back wall, in a manner as is known. The illustrated storage units 40 include an open front within which a series of shelves 45 are mounted, again in a manner as is known. It should be understood that, while storage units 40 are illustrated as shelving units, carriages 30 may be use to mount any other type of storage units such as file cabinets, disc or data storage cabinets, bookcases, etc. The mobile storage system 20 may be constructed as original equipment, or may be assembled in a retrofit manner using storage units already in use by an office or other facility in a stationary arrangement.

In a typical installation, the carriages 30 are supported on the stationary rail system 32. The carriages 30 are moveable (illustrated by arrow 47) on the rail system 32 for selectively creating an aisle between adjacent sets of storage units 40. The rail system 32 includes a series of parallel rails 50 that are preferably formed in sections and spliced together to provide a desired length. The carriage 30 is adapted for placement over the rail 50 and is configured to support the at least one storage unit 40 for movement on the rail 50. It is understood that the mobile storage system 20 can employ any number of movable carriages 30 and/or rails 50 and is not limiting on the invention. The overall general construction of mobile storage system 20 is known in the art, and systems of this type are available from Spacesaver Corp. of Fort Atkinson, Wis. in a variety of configurations and models.

Figure 5:
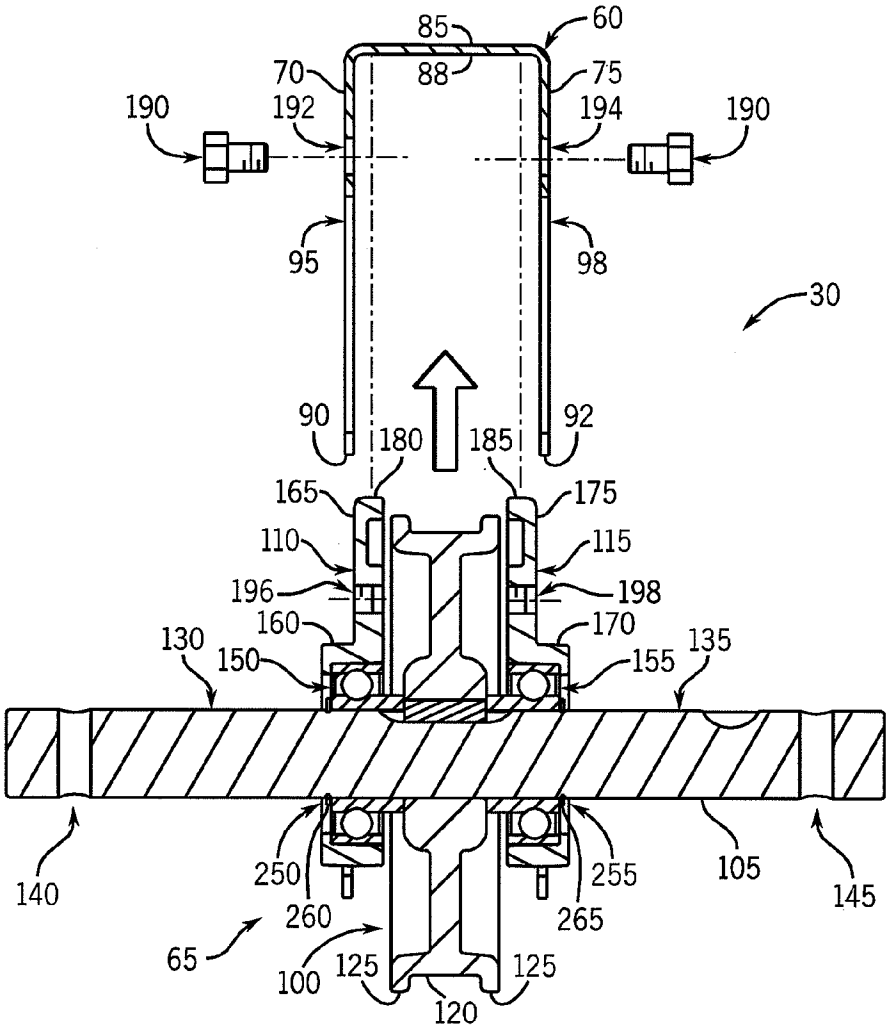
FIG. 5 is an exploded cross-sectional view showing the modular wheel assembly of FIGS. 2 and 3 and a structural member of the carriage as shown in FIG. 4.

As illustrated in FIGS. 2 and 4-5, the preferred carriage 30 includes a wheel mount structure 60 (shown in dashed line in FIG. 2) to which one or more wheel subassemblies 65 are mounted. In one embodiment, the wheel mount structure 60 is generally U-shaped and includes a first sidewall 70 spaced apart from a second sidewall 75, with a space 80 defined therebetween. The wheel mount structure 60 may be in the form of a structural member or beam forming a part of carriage 30, or may be a component separate from and mounted in any satisfactory manner to carriage 30.

The wheel mount structure 60 includes an upper wall 85 located and interconnected between the first sidewall 70 and the second sidewall 75. The upper wall 85 defines an inner surface 88 facing the space 80. The first and second sidewalls 70 and 75 include lower edges 90 and 92, respectively. Each lower edge 90 and 92 generally defines an opening 95 and 98 of the first and second sidewalls 70 and 75, respectively. The preferred openings 95, 98 in each of the first and second sidewalls 70 and 75 of the wheel mount structure 60 are aligned slots extending upwardly from the lower edges 90 and 92, respectively. Although slots are shown, the type of openings 95, 98 in the first and sidewalls 70 and 75 of the wheel mount structure 60 can vary.

FIGS. 2 and 4-6 illustrate the components incorporated in a preferred wheel mount structure 60 and wheel subassembly 65 at one end of the carriage 30, with the understanding that other wheel mount structures 60 and wheel subassemblies 65 of the carriage 30 are constructed of similar components in a similar manner.

As shown in FIGS. 2-3 and 5-6, the preferred wheel subassembly 65 generally includes a wheel 100, a drive shaft 105, a first mounting member 110 and a second mounting member 115 that are configured as a unit or subassembly that is dropped or mounted into position with the wheel mount structure 60, in a manner to be explained.

The wheel 100 generally defines a primary rolling surface 120 and a guide to engage the rails 50 of the mobile storage system 20. Referring to FIG. 3, the guide of wheel 100 generally includes an outwardly-extending dual guide flange 125. Although the wheel 100 is illustrated with an outwardly extending guide flange 125, the type of guide configuration can vary and is not limiting on the invention.

The preferred shaft 105 is generally a "stub" axle or drive shaft with ends 130 and 135 that extend outwardly from the wheel 100 in opposite directions. The first end 130 of the drive shaft 105 extends through the first mounting member 110, and the second end 135 of the drive shaft 105 extends through the second mounting member 115. The first and second openings 95 and 98 of the first and second sidewalls 70 and 75 of the wheel mount structure 60 are adapted to receive the first and second ends 130 and 135 of the drive shaft 105 of the wheel subassembly 65. The first stub shaft 130 includes a first opening 140, and the second stub shaft 135 includes a second opening 145.

Figure 6:
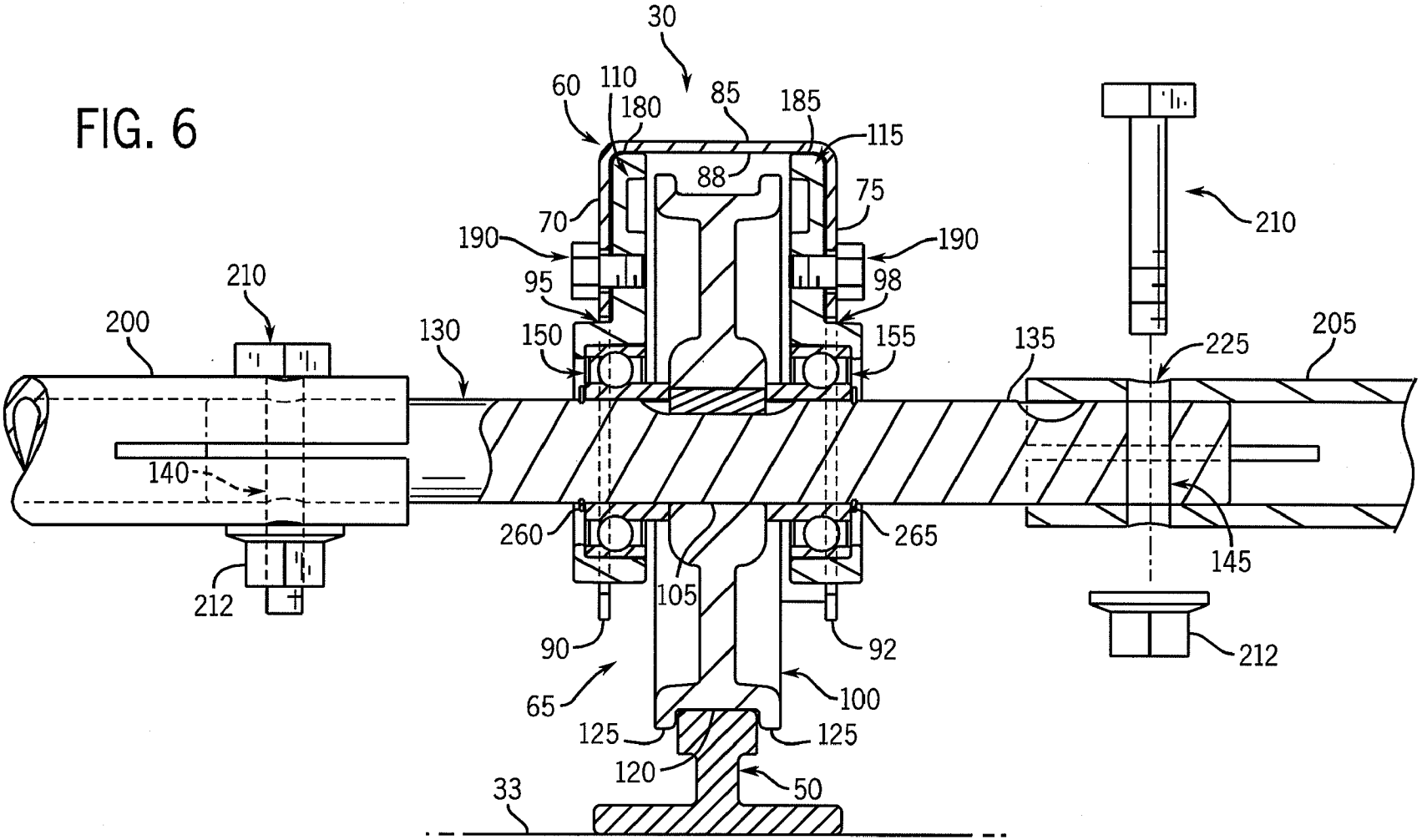
FIG. 6 is a cross-sectional view of the carriage and modular wheel assembly, taken along line 6-6 in FIG. 4.

Referring to FIGS. 5 and 6, the preferred first mounting member 110 is in the form of a bearing housing that includes a first bearing 150 to receive the first end 130 of the drive shaft 105, and the preferred second mounting member 115 is in the form of a bearing housing that includes a second bearing 155 to receive the second end 135 of the drive shaft 105. The first mounting member 110 generally includes a first bearing engagement or rim section 160 which encircles the first bearing 150, and a first mounting section 165 that extends upwardly from the first bearing engagement section 160. The second mounting member 115 generally includes a second bearing engagement or rim section 170 which encircles the second bearing 155, and a second mounting section 175 that extends upwardly from the second bearing engagement section 170. The upper edges 180, 185 of the mounting sections 165 and 175, respectively, engage the inward or inner surface 88 of the upper wall 85 of the wheel mount structure 60. The upper edges 180 and 185 are generally flat and generally extend throughout the length of the engagement sections 160 and 170.

Still referring to FIGS. 5 and 6, a fastener 190 (e.g., a threaded screw) extends through a first and a second aperture 192 and 194 formed in each of the first and second sidewalls 70 and 75, respectively, of the wheel mount structure 60 and into engagement with a first and a second aperture 196 and 198, respectively, formed in each of the first and second mounting members 110 and 115. In this manner, the first and second mounting members 110 and 115 of the wheel subassembly 65 are secured to the first and second sidewalls 70 and 75 of the wheel mount structure 60. Engagement of the upper edges 180 and 185 of the first and second mounting members 110 and 115 against the inner surface 88 of the upper wall 85 of the wheel mount structure 60 reduces any tendency of the first and second mounting members 110 and 115 to rotate relative to the wheel mount structure 60.

As illustrated in FIGS. 2 and 6, the preferred carriage 30 further includes first and second connecting shafts 200 and 205, respectively, that are connected at the ends 130 and 135, respectively, of the aligned drive shaft 105 in a manner such that the connecting shafts 200 and 205 transfer rotary power to rotate the shaft 105 and attached wheel 100. In a manner as is known, mobile storage system 20 includes a satisfactory drive arrangement (not shown) for imparting rotation to connecting shafts 200, 205 to move carriage 30, such as a manual, manual assist, or powered drive system including an electric motor.

Each connecting shaft 200 and 205 includes a recess to receive the ends 130 and 135 of the drive shaft 105. A fastener 210 secures each end of the drive shaft 105 with each drive shaft 200 and 205 in a manner such that a drive force in the connecting shafts 200 and 205 imparts a rotational force on the shaft 105 and wheel 100 so as to move the carriage 30 on the rail 50.

In the illustrated embodiment, each fastener 210 extends into the openings 140 and 145 formed in each end 130 and 135 of the drive shaft 105, and is engaged with a retainer such as a nut 212. In this manner, the connecting shafts 200 and 205 are engaged with the drive shaft 105 by simply inserting one of the ends 130 and 135 of the drive shaft 105 into the recess at the end of the connecting shafts 200 and 205 and positioning the fastener 210 through openings 220 and 225 formed in each connecting shaft 200 and 205 and through the openings 140 and 145 in the ends 130 and 135, respectively, of the drive shaft 105. Nuts 212 are then engaged with fasteners 210. The connecting shafts 200 and 205 extend between and are interconnected with the facing stub shafts of adjacent wheel subassemblies 65 (not shown) mounted to adjacent structural members of carriage 30. In this manner, the drive shafts 200 and 205 function to transfer power, in response to application of the drive force, to move the carriage 30 on the rails 50.

In operation, the carriage 30 is configured to support one or more storage units 40 for movement on the rail 50. The wheel subassembly 65 is mounted to the wheel mount structure 60, forming a part of the carriage 30 of the mobile storage system 20. The wheel mount structure 60, which is a structural member of carriage 30, is configured to receive the wheel subassembly 65. The wheel subassembly 65 is formed with the wheel 100 mounted to the drive shaft 105 and connected between the first and second mounting members 110 and 115, respectively. The formed wheel subassembly 65 is dropped into position in the wheel mount structure 60. Each of the first and second mounting members 110 and 115 engages within the openings 95 and 98 in the spaced apart sidewalls 70 and 75 of the wheel mount structure 65. The act of engaging the mounting member 110 within the space 80 and against the first wheel mount structure sidewall 70 is carried out by positioning the engagement or rim section 160 within the opening 95 in the wheel mount structure sidewall 70. The engagement or rim section 170 of the mounting member 115 engages within the opening 98 in the second wheel mount structure sidewall 75 in a similar manner. Each of the first and second mounting members 110 and 115 includes an upper mounting section 165 and 175 that extends upwardly from the respective engagement section 160 and 170 and engages the surface 88 of the upper wall 85 of the wheel mount structure 60. Each of the first and second mounting members 110 and 115 is secured to the wheel mount structure sidewalls 70 and 75 by engaging fasteners 190 through apertures 192 and 194 in the wheel mount structure walls 70 and 75 and in through the apertures 196 and 198 in the upper mounting sections 165 and 175 of the first and second mounting members 110 and 115, respectively.

Each of the first and second mounting members 110 and 115 engages within the openings 95 and 98 in the wheel mount structure sidewalls 70 and 75, respectively, by positioning the first and second mounting members 110 and 115 adjacent against an inner surface defined by the walls 70 and 75 of the wheel mount structure 60, while the engagement sections 160 and 170 of the first and second mounting members 110 and 115 extend outwardly into the openings 95 and 98 of the first and second sidewalls 70 and 75 of the wheel mount structure 60. The engagement sections 160 and 170 surround openings 250 and 255 (FIG. 3) in each of the first and second mounting members 110 and 115, within which the shaft 105 is rotatably supported, and retainer rings 260 and 265 secure the mounting members 110 and 115 in position on the shaft 105.

Figure 7:
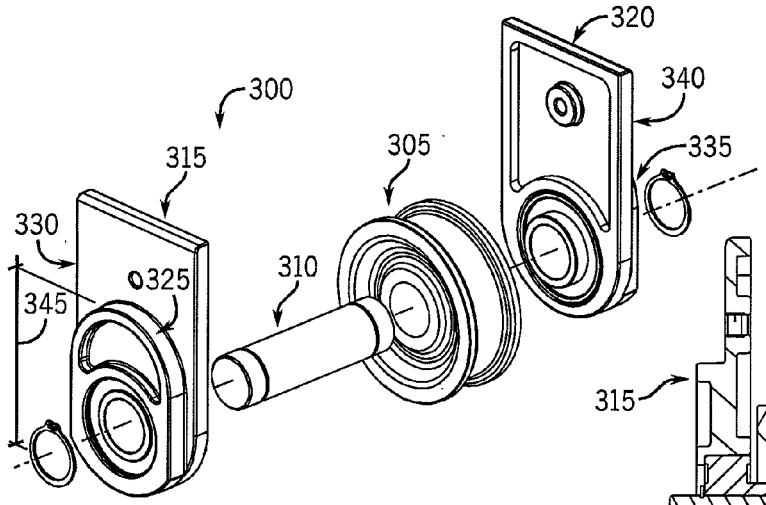
FIG. 7 is an exploded isometric view similar to FIG. 3, showing another embodiment of a modular wheel assembly in accordance with the invention.
Figure 8:
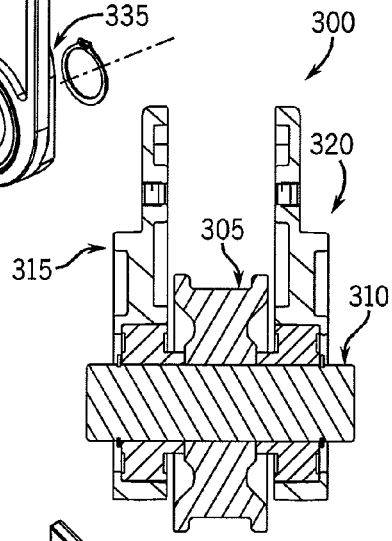
FIG. 8 is a cross sectional view of the modular wheel assembly shown in FIG. 7.

FIGS. 7 and 8 illustrate another embodiment of a wheel subassembly 300 that includes a wheel 305, a load shaft 310, a first mounting member 315 and a second mounting member 320 constructed in a similar manner to the wheel 100, shaft 105, first mounting member 110 and second mounting member 115 of the wheel subassembly 65 described above. The first mounting member 315 includes an engagement or rim section 325 and a mounting section 330, and the second mounting member 320 includes an engagement section 335 and a mounting section 340. The engagement sections 325 and 335 are generally oval-shaped and of a height 345 greater than a height 350 of the generally circular-shaped engagement sections 160 and 170 of the mounting members of the wheel subassembly 65 described above. The oval-shaped engagement sections 325 and 335 are configured to position the wheel subassembly 300 lower below the inner surface 88 of the upper wall 85 of the wheel mount structure 60 (See FIG. 5). The wheel 305 is of a generally smaller diameter in comparison to the wheel 100 illustrated in FIG. 5. Also, the shaft 310 is not configured to attach to a drive mechanism, in contrast to the shaft 105 described above, and is thus operable to simply support carriage 30 for rolling movement on rail 50.

Figure 9:
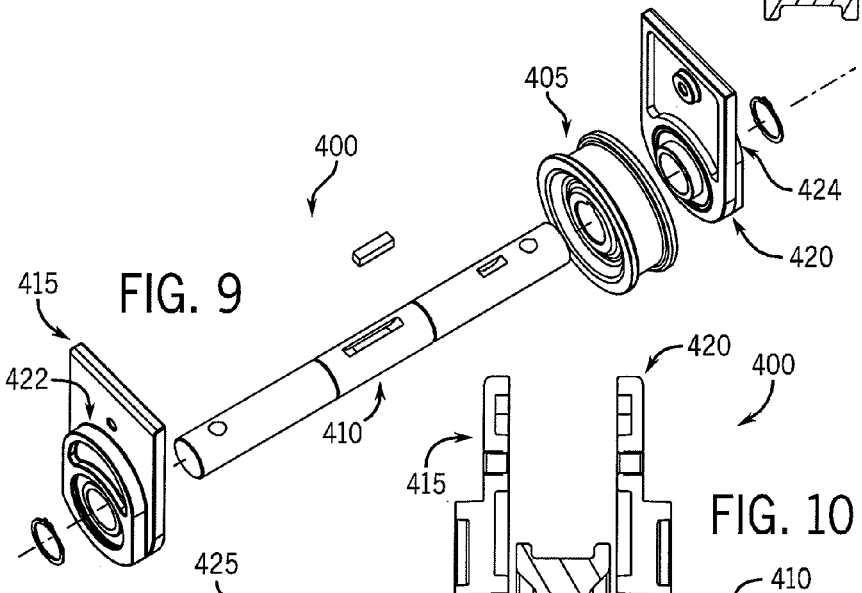
FIG. 9 is an exploded isometric view of yet another embodiment of a modular wheel assembly in accordance with the present invention.
Figure 10:
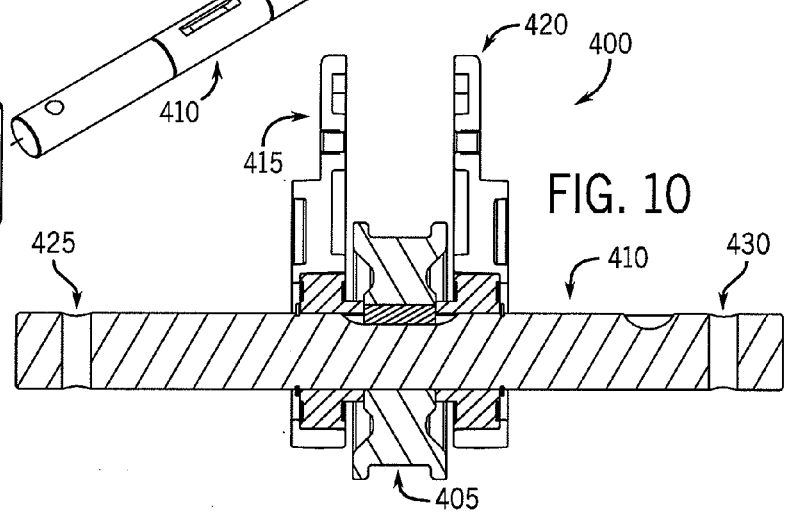
FIG. 10 is a cross-sectional view of the modular wheel assembly shown in FIG. 9.

FIGS. 9 and 10 illustrate yet another embodiment of a wheel subassembly 400 that includes a wheel 405, a shaft 410, a first mounting member 415 and a second mounting member 420 constructed in a similar manner to the wheel 100, shaft 105, and first and second mounting members 110 and 115 of the wheel subassembly 65 described above. The mounting members 415 and 420 include generally oval-shaped engagement sections 422 and 424, similar to the engagement sections 325 and 335 of the mounting members 315 and 320 described above. The stub shaft 410 includes openings 425 and 430 and is of size and dimension similar to the drive shaft 105 described above.

It can thus be appreciated that the present invention provides a wheel mounting arrangement for a mobile storage system 20 which provides significant advantages over the prior art. With the wheel mounting system of the present invention, the wheels are quickly and easily mounted to the carriage by dropping each wheel subassembly into the openings or recesses in the wheel mount area of a structural member of the carriage, and using just two fasteners to secure the wheel subassembly to the carriage. In addition, the mounting members of each wheel subassembly are configured to transfer loads directly to the upper surface of the structural member of the carriage by engagement between the upper edge of the mounting member and the upper wall of the carriage member, thus relieving the bearings and their associated connections, as well as the side walls of the carriage member, from exposure to loads experienced by the wheels.

Various alternatives and embodiments are contemplated as being within the scope of the following claims particularly pointing out and distinctly claiming the subject matter regarded as the invention.

We claim:

1. A carriage for a mobile storage system, wherein the carriage is adapted for placement over a rail and is configured to support at least one storage unit for movement on the rail in response to a drive arrangement, comprising:

a wheel mount structure;

a shaft defining a pair of ends;

a wheel mounted to the shaft;

a first and a second mounting member to which the shaft is rotatably mounted, wherein the wheel is located between the first and second mounting members and wherein each end of the shaft extends outwardly from one of the first and second mounting members; and a cooperating mounting arrangement associated with the wheel mount structure and the first and second mounting members for non-rotatably mounting the first and second mounting members to the wheel mount structure, wherein the cooperating mounting arrangement is configured such that the wheel extends downwardly from the wheel mount structure for engagement with the rail and wherein the ends of the shaft extend outwardly from the wheel mount structure, and wherein one of the ends of the shaft engages a drive arrangement associated with the carriage that imparts rotation to the shaft and thereby imparts rotation to the wheel.

2. The carriage of claim 1, wherein the wheel mount structure includes a first sidewall and a second sidewall that define a space therebetween, and wherein the cooperating mounting arrangement includes an opening in each of the first and second sidewalls and an engagement section associated with each of the first and second mounting members, wherein each engagement section is configured to be received within the opening in each of the first and second sidewalls of the wheel mount structure.

3. The carriage of claim 2, wherein each of the first and second mounting members is secured to one of the first and second sidewalls of the wheel mount structure by one or more fasteners.

4. The carriage of claim 3, wherein each first and second mounting member is adapted to be positioned within the space defined between the first and second sidewalls of the wheel mount structure, and wherein the engagement section of each first and second mounting member extends outwardly through the opening in each of the first and second sidewalls of the wheel mount structure.

5. The carriage of claim 4, wherein the wheel mount structure includes an upper wall that extends between and interconnects the first and second sidewalls, and wherein each of the first and second mounting members includes an upper edge that engages an interior surface defined by the upper wall of the wheel mount structure.

6. The carriage of claim 5, wherein the one or more fasteners are located between the upper edge and the engagement section of each of the first and second mounting members.

7. The carriage of claim 2, wherein each of the first and second sidewalls of the wheel mount structure defines a lower edge, and wherein the opening in each wheel mount structure extends upwardly from the lower edge, and wherein the engagement section of each of the first and second mounting members includes a rim that surrounds an opening through which the shaft extends, wherein the rim and the opening in each of the first and second wheel mount structure sidewalls have a matching configuration that enables the rim to be received within the opening in each of the first and second wheel mount structure sidewalls.

8. The carriage of claim 1, wherein the shaft, the wheel, and the first and second mounting members comprise a wheel subassembly that is secured as a unit to the wheel mount structure.

9. A method of mounting a wheel to a carriage in a mobile storage system, wherein the carriage is configured to support one or more storage units for movement on a rail, comprising the acts of:

providing the carriage with a wheel mount structure having a first sidewall spaced apart from a second sidewall;

forming an opening in each of the first and second sidewalls of the wheel mount structure;

providing a wheel assembly including a shaft, a wheel mounted to the shaft, and a first and a second mounting member to which the shaft is rotatably mounted, wherein the wheel is located between the first and second mounting members;

engaging each of the first and second mounting members within the opening in one of the spaced apart first and second sidewalls of the wheel mount structure; and securing each of the first and second mounting members to the wheel mount structure sidewalls.

10. The method of claim 9, wherein each of the first and second wheel mount structure sidewalls defines a lower edge, and wherein the act of forming an opening in each of the first and second wheel mount structure sidewalls is carried out by forming the opening so as to extend upwardly from the lower edge of each of the first and second wheel mount structure sidewalls.

11. The method of claim 10, wherein the act of engaging each of the first and second mounting members within the opening in one of the first and second wheel mount structure sidewalls is carried out by positioning a rim section defined by each of the first and second mounting members within the opening in each of the first and second wheel mount structure sidewalls.

12. The method of claim 11, wherein each of the first and second mounting members includes an upper section that extends upwardly from the rim section, and wherein the act of securing each of the first and second mounting members to the first and second wheel mount structure sidewalls is carried out by engaging one or more fasteners with each of the first and second wheel mount structure sidewalls and with the upper section of each of the first and second mounting members.

13. The method of claim 12, wherein the act of engaging each of the first and second mounting members within the opening in each of the first and second wheel mount structure sidewalls is carried out by positioning each of the first and second mounting members adjacent an inner surface defined by each of the first and second wheel mount structure sidewalls such that the rim section of each of the of the first and second mounting members extends outwardly into the opening of each of the first and second wheel mount structure sidewalls.

14. The method of claim 13, wherein the wheel mount structure includes an upper wall that extends between and interconnects the spaced apart sidewalls of the wheel mount structure, and wherein the upper section of each of the first and second mounting members defines an upper edge, and further comprising the act of positioning the upper edge of each of the first and second mounting members adjacent to an inner surface defined by the upper wall of the wheel mount structure.

15. The method of claim 11, wherein the rim section defined by each of the first and second mounting members surrounds an opening through which the shaft extends.

16. In a mobile storage system including one or more storage units and a carriage adapted to movably support the one or more storage units on one or more rails, the improvement comprising:

a wheel mount structure associated with the carriage; and a wheel subassembly engagement with the wheel mount structure, the wheel subassembly including:

a wheel configured to engage one of the rails;

a first and a second mounting member between which the wheel is located; and a shaft that is rotatably supported by the first and second mounting members, wherein the wheel is non-rotatably secured to the shaft, and wherein the wheel mount structure and the first and second mounting members include cooperating engagement structure for non-rotatably engaging the first and second mounting members with the wheel mount structure.

17. The improvement of claim 16, wherein the wheel mount structure includes a first sidewall spaced apart from a second sidewall and a space defined therebetween, wherein the cooperating engagement structure comprises an opening in each of the first and second wheel mount structure sidewalls and an engagement section on each of the first and second mounting members, and wherein each engagement section is configured to be received and engaged within the opening in each of the first and second wheel mount structure sidewalls.

18. The improvement of claim 17, wherein each of the first and second mounting members is secured to one of the first and second sidewalls of the wheel mount structure by one or more fasteners.

19. The improvement of claim 18, wherein each of the first and second mounting members is adapted to be positioned within the space between the spaced apart first and second wheel mount structure sidewalls, and wherein the engagement section of each of the first and second mounting members extends outwardly into the opening in one of the first and second wheel mount structure sidewalls.

20. The improvement of claim 19, wherein the wheel mount structure includes an upper wall that extends between and interconnects the spaced apart first and second sidewalls, and wherein each of the first and second mounting members includes an upper edge that engages an inner surface defined by the upper wall of the wheel mount structure.

21. The improvement of claim 20, wherein the fastener arrangement is located between the upper edge and the engagement section of each mounting member.

22. The improvement of claim 17, wherein each of the wheel mount structure sidewalls defines a lower edge, and wherein the opening in each wheel mount structure sidewall extends upwardly from the lower edge, and wherein the engagement section of each mounting member includes a rim that surrounds an opening in the mounting member through which the shaft extends, wherein the rim and the opening in each wheel mount structure sidewall have a matching configuration that enables the rim to be received within the opening.

* * * * *